US011114082B1

(12) United States Patent
Carlsson

(10) Patent No.: US 11,114,082 B1
(45) Date of Patent: Sep. 7, 2021

(54) NOISE CANCELATION TO MINIMIZE SOUND EXITING AREA

(71) Applicant: Sony Corporation, Tokyo (JP)

(72) Inventor: Gregory Carlsson, Santee, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/856,972

(22) Filed: Apr. 23, 2020

(51) Int. Cl.
*G10K 11/16* (2006.01)
*G10K 11/178* (2006.01)

(52) U.S. Cl.
CPC ..... *G10K 11/17857* (2018.01); *G10K 2210/3012* (2013.01)

(58) Field of Classification Search
CPC ..... G10K 11/17857; G10K 2210/3012
USPC ..... 381/71.7, 71.8, 71.12, 71.1
See application file for complete search history.

(56) References Cited

U.S. PATENT DOCUMENTS 10,593,316 B1 3/2020 Cunningham
2007/0003097 A1* 1/2007 Langberg ..... H04R 5/02 381/386
2010/0296660 A1* 11/2010 Kim ..... H04R 1/323 381/59
2012/0075957 A1 3/2012 Bruijn
2017/0238120 A1* 8/2017 Milne ..... H04R 5/02 381/17
2017/0280265 A1 9/2017 Po

FOREIGN PATENT DOCUMENTS

JP 2011133880 A 7/2011
WO 2018168478 A1 9/2018

OTHER PUBLICATIONS

Gniazdo, Daniel, "ANC headsets aren't all the same: The three types of ANC", Jabra Blog, Sep. 25, 2015.

* cited by examiner

*Primary Examiner* — Ammar T Hamid
(74) *Attorney, Agent, or Firm* — John L. Rogitz

(57) ABSTRACT

A networked speaker system includes plural speaker assemblies around the perimeter of a space with sound axes oriented up and inward into the space. Each speaker assembly includes an audio transducer to output demanded sound and a noise cancelation transducer which is driven to cancel sound from other speaker assemblies in the space based on signals from a microphone on the speaker assembly and location and device information from the other speaker assemblies.

19 Claims, 4 Drawing Sheets

Networked-Speaker Block diagram

Networked-Speaker Block diagram

NOISE CANCELATION TO MINIMIZE SOUND EXITING AREA

FIELD

The present application relates generally to noise cancelation in speaker systems to limit the amount of sound that exits a room or other area in which speakers are playing.

BACKGROUND

U.S. Pat. Nos. 9,288,597, 9,560,449, 9,866,986, 9,402,145, 9,369,801, 9,426,551, 9,826,332, 9,924,291, 9,693,169, 9,854,362, 9,924,286, and USPP 2018/115,825, owned by the present assignee and all incorporated herein by reference, teach techniques related to audio speaker systems and more particularly to wirelessly networked audio speaker systems. By wirelessly networking speakers in a system, flexibility is enhanced, because users can easily move speakers to locations in buildings as they desire and otherwise configure the audio system setup without the nuisance of wiring. Also incorporated by reference is co-owned U.S. Pat. No. 9,369,801 describing noise cancelation techniques.

SUMMARY

As understood herein, people frequently wish to listen to music at sound pressure levels that may disturb their neighbors, whether it be an outdoor or indoor environment. As also understood herein, existing noise canceling techniques do not work well at high frequency or in unknown acoustic environments with unknown loudspeaker locations.

Accordingly, in one aspect an apparatus includes at least a first audio speaker assembly including at least a first transducer and a second transducer. At least the first transducer defines a sonic axis oriented upwardly at an oblique angle with respect to horizontal. The first audio speaker assembly also includes at least a first microphone and at least one processor programmed with instructions to receive signals from the first microphone and to control the first and second transducers. The apparatus also includes at least a second audio speaker assembly including at least a third transducer and a fourth transducer. At least the third transducer defines a sonic axis oriented upwardly at an oblique angle with respect to horizontal and toward the first audio speaker assembly. The second audio speaker assembly also includes at least a second microphone and at least one processor programmed with instructions to receive signals from the second microphone and to control the third and fourth transducers. Additionally, the apparatus includes storage accessible to at least one processor and that includes instructions executable by at least one processor. The instructions are executable to produce first sound using one of the first transducer and the third transducer, identify noise cancellation signals to cancel second sound that is produced using the other of the first transducer and the third transducer, and receive at least a first signal from at least one microphone. The instructions are also executable to produce third sound using one or more of the second transducer and the fourth transducer. The third sound is produced based on the noise cancellation signals, based on a current location of one or more of the first and second audio speaker assemblies, and based on the first signal from the at least one microphone. The third sound at least partially cancels the second sound.

Accordingly, in some implementations the instructions may be executable to produce the first sound using the first transducer and to identify, at the first audio speaker assembly, the noise cancellation signals to cancel the second sound. The instructions may also be executable to receive at least the first signal from the first microphone and to produce the third sound using the second transducer, where the third sound may be produced based on the noise cancellation signals, based on a current location of the second audio speaker assembly, and based on the first signal from the first microphone.

Furthermore, in some of these implementations the noise cancellation signals may be first noise cancellation signals, and the instructions may be executable to produce the second sound using the third transducer and to identify, at the second audio speaker assembly, second noise cancellation signals to cancel the first sound. The instructions may also be executable to receive at least a second signal from the second microphone and to produce fourth sound using the fourth transducer. The fourth sound may be produced based on the second noise cancellation signals, based on a current location of the first audio speaker assembly, and based on the second signal from the second microphone. The fourth sound may at least partially cancel the first sound.

Additionally, in some examples the first sound and the second sound may be produced based on signals from a source device. The third sound and the fourth sound may also be produced based on signals from the source device, and/or the third sound may be produced based on signals from the second audio speaker assembly while the fourth sound may be produced based on signals from the first audio speaker assembly.

Still further, if desired the first signal from the first microphone may be used to alter the first noise cancellation signals, and the second signal from the second microphone may be used to alter the second noise cancellation signals.

In some example embodiments, the first noise cancellation signals may even be altered based on a frequency response, sound pressure level (SPL), and/or phase response of the second audio speaker assembly, while the second noise cancellation signals may be altered based on a frequency response, SPL, and/or phase response of the first audio speaker assembly. Also in some example embodiments, the current location of the second audio speaker assembly may be used to determine timing information for production of the third sound at the first audio speaker assembly, while the current location of the first audio speaker assembly may be used to determine timing information for production of the fourth sound at the second audio speaker assembly. The current locations of the first and second audio speaker assemblies may be determined using ultrasonic signals, ultra-wide band (UWB) signaling, Wi-Fi signals, and/or Bluetooth signals, for example.

Additionally, in some implementations the first and second noise cancellation signals may be generated using at least one active noise cancelling algorithm.

Also in some implementations, the first and second noise cancellation signals may be generated to cancel sound in frequencies up to one kilohertz (kHz) but not frequencies above one kHz.

In another aspect, a method includes producing first sound at a first speaker assembly using a first transducer on the first speaker assembly. The method also includes identifying first noise cancellation signals to cancel second sound from a second speaker assembly different from the first speaker assembly. Still further, the method includes producing third sound at the first speaker assembly using a second transducer on the first speaker assembly concurrent with producing the first sound at the first speaker assembly. The third sound is produced based on the first noise cancellation signals, with the third sound cancelling at least some portions of the second sound that are below one kilohertz.

In still another aspect, at least one computer readable storage medium (CRSM) that is not a transitory signal includes instructions executable by at least one processor to produce first sound at a first speaker assembly using a first transducer on the first speaker assembly. The instructions are also executable to identify first noise cancellation signals to cancel second sound from a second speaker assembly different from the first speaker assembly. Additionally, the instructions are executable to produce a third sound at the first speaker assembly using a second transducer on the first speaker assembly concurrent with producing the first sound using the first transducer. The third sound cancels at least a portion of the second sound, with the third sound being produced based on the first noise cancellation signals.

The details of the present application, both as to its structure and operation, can be best understood in reference to the accompanying drawings, in which like reference numerals refer to like parts, and in which:

DETAILED DESCRIPTION

Figure 1:
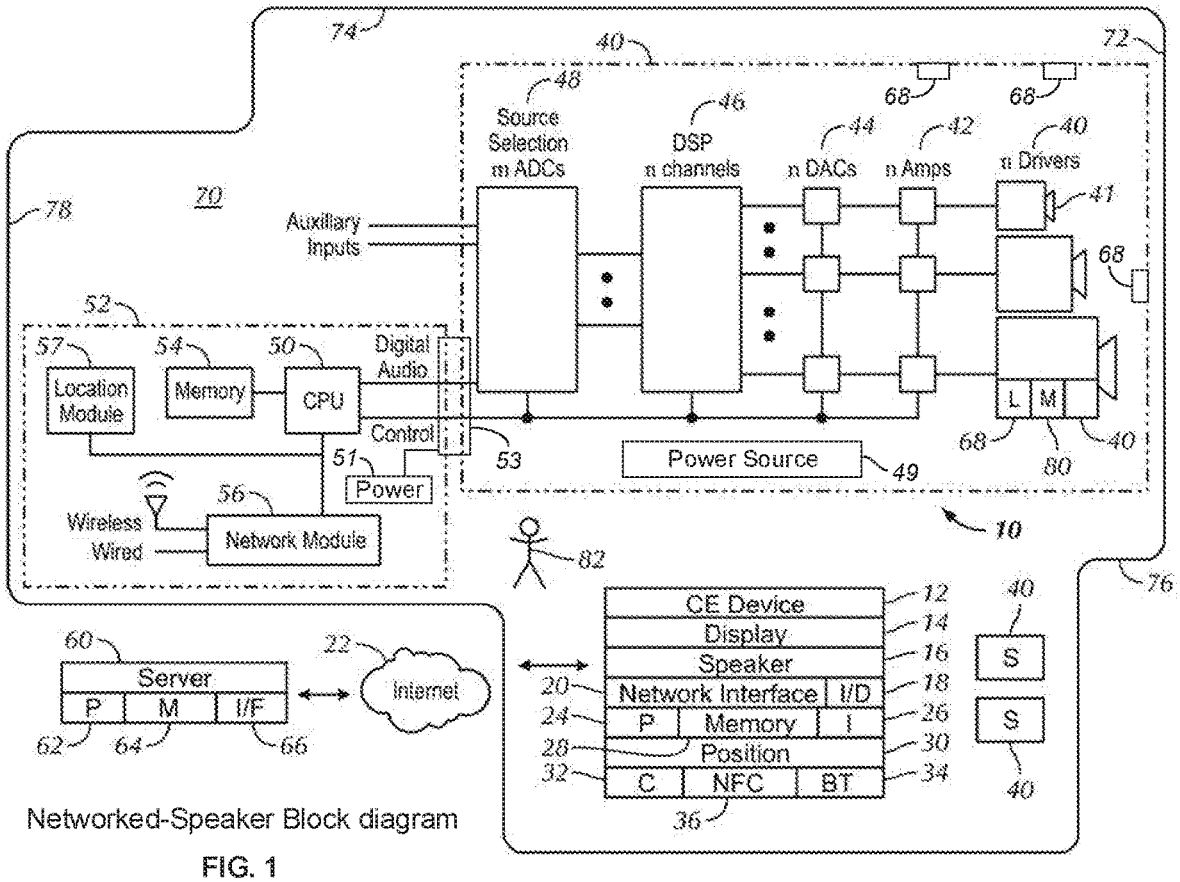
FIG. 1 is a block diagram of an example wireless audio speaker system consistent with present principles.

In overview, audio speakers (in some cases four or more) may be placed roughly around the perimeter of the intended listening area. Each speaker may include at least one microphone and at least one transducer, with the transducers oriented at an angle such that they are neither facing horizontal or vertical, but inward toward the listening area and upward. The reason for this transducer orientation is to take advantage of the directional nature of mid and high frequency sound and the power beaming effect of audio transducers to naturally limit the escape of mid and high frequency sound from the intended listening area.

Active noise cancelling may be used to limit the spread of low to mid frequency sound (e.g., up to roughly 1 kHz). To make active noise canceling feasible in a loudspeaker system with non-fixed locations and unknown acoustic environments, a combination of microphones in the speakers, speaker location detection (such as by using ultrasonic signals, ultra-wide band (UWB) signaling, Wi-Fi, Bluetooth®), and known characteristics of the loudspeakers (frequency response, polar sound pressure level (SPL), phase response) may be used as described more fully herein. A common source signal (such as from a mobile phone for example) may be used to optimize noise canceling.

In this way, consumers are allowed to listen to music at high volume without concern for disturbing their neighbors. In addition to consumer environments, present principles apply to concert venues, clubs, bars, or other events, both indoor and outdoor.

Thus, the speakers may be oriented with their sound axes pointing up and in toward each other to limit dispersion of high frequency sound (e.g., speakers pointed at each other in a circle as arranged by an end-user). Taking advantage of the directionality of higher frequencies and of power-beaming (e.g., playing sound very loud), instead of just placing speakers on the ground to project sound horizontally (e.g., in outdoor use case), the speaker sonic axes are oriented up from the horizontal at, e.g., 45 degrees to reduce amount of high frequency perceptible to nearby neighbors. Then, noise cancelation may be used to reduce the amount of low frequency energy. A network of speakers share their audio signals and/or noise cancelation signals between them along with location data. Assuming the speakers share certain acoustic parameters and knowing their models/model numbers, each one could know the frequency response for the other speakers' model.

The noise cancelation signals output by each speaker might vary. Thus, while the noise cancelation signals can be the same and known by each speaker, they may also be different but still known signals (e.g., same signal, or left or right channel signals). Each speaker may know the audio being played by the other speaker, and by knowing the timing of when it is presented and knowing the relative locations of the speakers with respect to each other, timing information may be derived for outputting the noise cancelation signals (whether the signals are received from the other speaker or generated based on the received audio signal).

In essence an active sound containment area may be created. Each speaker assembly may have two speakers/transducers, one for projecting audio into the containment area, and one facing outward to project the noise cancellation signals away from the containment area. The directivity of the noise cancellation signals may thus be limited so the containment area is narrowed using the additional sound-cancelation transducer on each speaker.

In some examples, noise cancelation signals from each speaker may be unique. Each speaker may have at least one microphone to accurately measure timing of sound from other speakers and to account for variability in the acoustic environment such as sound-reflective surfaces. Microphone signals may be used in conjunction with location and characteristic information from the other speakers to identify audio that is sought to be canceled.

So in sum, both transducers on each speaker device may fire sound up and out, but in different directions to cancel noise outward but to have the noise "area" inward.

With the above overview in mind, in addition to the instant disclosure, further details may use, for speaker location information, ultra-wide band (UWB) techniques disclosed in one or more of the following location determination documents, all of which are incorporated herein by reference: U.S. Pat. Nos. 9,054,790; 8,870,334; 8,677,224; 8,437,432; 8,436,758; and USPPs 2008/0279307; 2012/0069868; 2012/0120874. Also incorporated by reference is U.S. Pat. No. 9,369,801 describing noise cancelation techniques.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google.

These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general-purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general-purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, Wi-Fi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more computer memories 28 such as disk-based or solid-state storage that are not transitory signals. Also, in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charge a battery (not shown) powering the CE device 12.

In some examples, the CE device 12 may function in connection with the below-described "master" or the CE device 12 itself may establish a "master". A "master" is used to control multiple ("n", wherein "n" is an integer greater than one) speakers 40 in respective speaker housings, each of can have multiple drivers 41, with each driver 41 receiving signals from a respective amplifier 42 over wired and/or wireless links to transduce the signal into sound (the details of only a single speaker shown in FIG. 1, it being understood that the other speakers 40 may be similarly constructed). Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit.

The DSP 46 may receive source selection signals over wired and/or wireless links from plural analog to digital converters (ADC) 48, which may in turn receive appropriate auxiliary signals and, from a control processor 50 of a master control device 52, digital audio signals over wired and/or wireless links. The control processor 50 may access a computer memory 54 such as any of those described above and may also access a network module 56 to permit wired and/or wireless communication with, e.g., the Internet. The control processor 50 may also access a location module 57. The location module 57 may be implemented by a UWB module made by a member of the Fira Consortium or it may be implemented using the Li-Fi principles discussed in one or more of the above-referenced patents or by other appropriate techniques including GPS. One or more of the speakers 40 may also have respective location modules attached or otherwise associated with them. As an example, the master device 52 may be implemented by an audio video (AV) receiver or by a digital pre-amp processor (pre-pro).

As shown in FIG. 1, the control processor 50 may also communicate with each of the ADCs 48, DSP 46, DACs 44, and amplifiers 42 over wired and/or wireless links. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40.

The CE device 12 and/or control device 52 of each individual speaker train (speaker+amplifier+DAC+DSP, for instance) may communicate over wired and/or wireless links with the Internet 22 and through the Internet 22 with one or more network servers 60. Only a single server 60 is shown in FIG. 1. A server 60 may include at least one processor 62, at least one tangible computer readable storage medium 64 such as disk-based or solid-state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, Wi-Fi transceiver, Li-Fi transceiver, or other appropriate interface such as, e.g., a wireless telephony transceiver.

Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the master and/or the CE device 12 for control of the speakers 40 according to logic below. The master/CE device 12 in turn can receive certain information from the speakers 40, such as their real time location from a real time location system (RTLS) such as but not limited to GPS or Li-Fi or UWB or other technique, and/or the master/CE device 12 can receive input from the user, e.g., indicating the locations of the speakers 40 as further disclosed below. Based on these inputs at least in part, the master/CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include one or more respective one or more light emitting diode (LED) assemblies 68 implementing Li-Fi communication to establish short-range wireless communication among the networked speakers shown. Also, the remote control of the user, e.g., the CE device 12, may include one or more LED assemblies.

As shown, the speakers 40 are disposed in the enclosure 70 such as a room, e.g., a living room. For purposes of disclosure, the enclosure 70 has (with respect to the example orientation of the speakers shown in FIG. 1) a front wall 72, left and right-side walls 74, 76, and a rear wall 78. One or more listeners 82 may occupy the enclosure 70 to listen to audio from the speakers 40. One or microphones 80 may be arranged in the enclosure for generating signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired.

Because of the portability afforded by wireless configurations, one or more components of the system shown in FIG. 1, such as one or more speakers, may be moved outside the enclosure 70 to an outside location such as a patio.

Disclosure below may make determinations using sonic wave calculations known in the art, in which the acoustic waves frequencies (and their harmonics) from each speaker, given its role as a bass speaker, a treble speaker, a subwoofer speaker, or other speaker characterized by having assigned to it a particular frequency band, are computationally modeled in the enclosure 70 and the locations of constructive and destructive wave interference determined based on where the speaker is and where the walls 72-78 are. As mentioned above, the computations may be executed, e.g., by the CE device 12 and/or by the cloud server 60 and/or master 52.

As an example, a speaker may emit a band of frequencies between 20 Hz and 30 Hz, and frequencies (with their harmonics) of 20 Hz, 25 Hz, and 30 Hz may be modeled to propagate in the enclosure 70 with constructive and destructive interference locations noted and recorded. The wave interference patterns of other speakers based on the modeled expected frequency assignations and the locations in the enclosure 70 of those other speakers may be similarly computationally modeled together to render an acoustic model for a particular speaker system physical layout in the enclosure 70 with a particular speaker frequency assignation. In some embodiments, reflection of sound waves from one or more of the walls may be accounted for in determining wave interference. In other embodiments reflection of sound waves from one or more of the walls may not be accounted for in determining wave interference. The acoustic model based on wave interference computations may furthermore account for particular speaker parameters such as but not limited to equalization (EQ). The parameters may also include delays, i.e., sound track delays between speakers, which result in respective wave propagation delays relative to the waves from other speakers, which delays may also be accounted for in the modeling. A sound track delay refers to the temporal delay between emitting, using respective speakers, parallel parts of the same soundtrack, which temporally shifts the waveform pattern of the corresponding speaker. The parameters can also include volume, which defines the amplitude of the waves from a particular speaker and thus the magnitude of constructive and destructive interferences in the waveform. Collectively, a combination of speaker location, frequency assignation, and parameters may be considered to be a "configuration".

FIG. 1 has a centralized control architecture in which the master device 52 or CE device 12 or other device functioning as a master renders two channel audio into as many channels are there are speakers in the system, providing each respective speaker with its channel.

Figure 2:
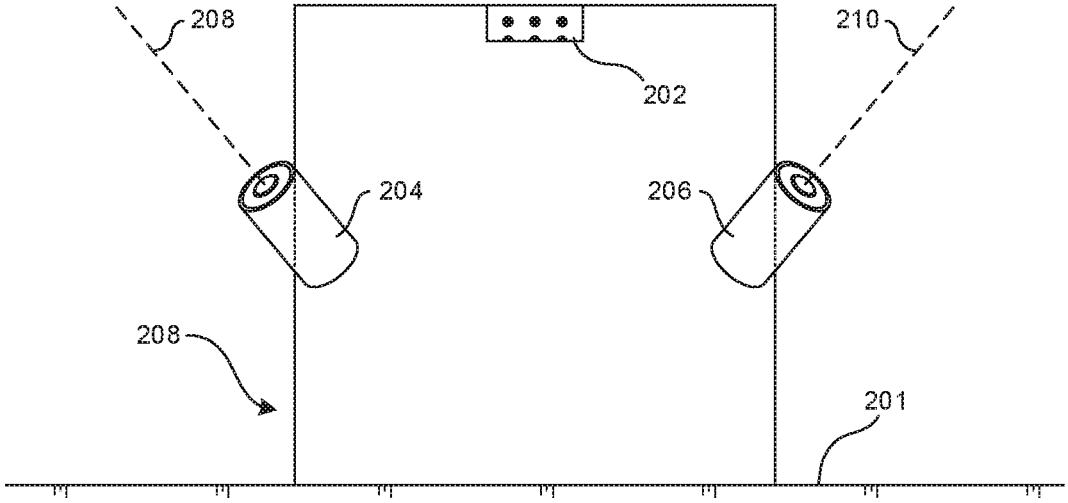
FIG. 2 shows a side cross-sectional view of an example speaker assembly consistent with present principles.

Referring now to FIG. 2, an example speaker/speaker assembly 200 is shown in side cross-sectional view while sitting upright on the ground 201 or another surface such as a coffee table. The assembly 200 may establish one of the speakers 40 referenced above.

As shown in FIG. 2, the assembly 200 may include a microphone 202 and other system components, including one or more of those described above with respect to the CE device 12. As also shown in FIG. 2, the assembly 200 may include a first transducer 204 and a second transducer 206 that may be controlled by a processor in the assembly 200 to output sound concurrently with each other.

As shown, the transducers 204, 206 may be oriented at an angle such that they are neither facing horizontal or vertical, but still upward. The transducers 204, 206 may be statically mounted within the housing of the assembly 200 at such orientations, or in some embodiments the transducers 204, 206 may be rotatable within the housing by an end-ser to establish the orientations (e.g., using an interference fit). Thus, as shown in FIG. 2 the transducers 204, 206 may be oriented with their respective sound axes 208, 210 pointing up and away from the assembly 200.

Figure 3:
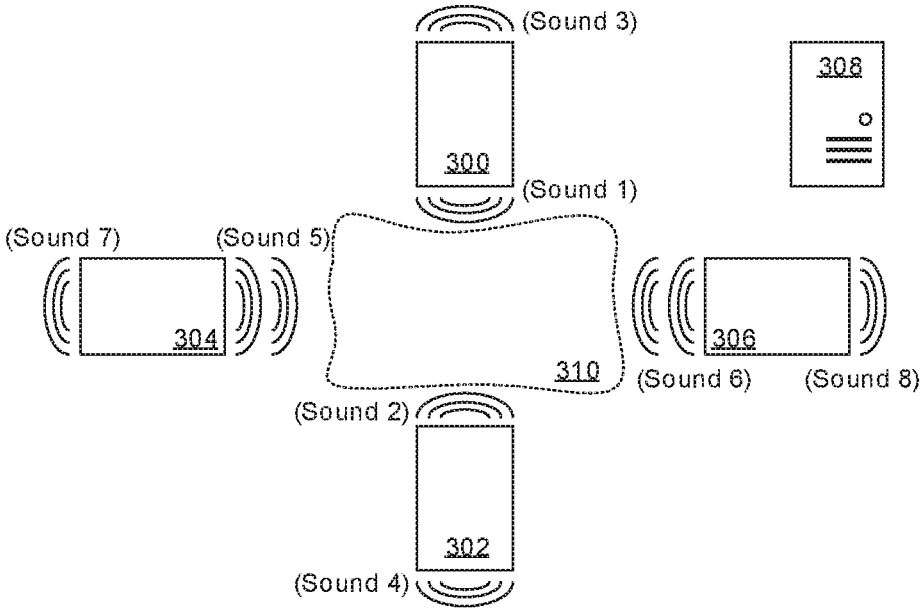
FIG. 3 shows a schematic diagram of four speaker assemblies and a containment area consistent with present principles.

FIG. 3 shows a schematic diagram of four speaker assemblies 300-306 that may be similar to the assembly 200 and arranged with respect to each other as shown by an end-user. A source device 308 is also shown, which may be a laptop computer, smart phone, MP3 player, or other device that streams audio signals to the assemblies 300-306 for presentation of sound corresponding to the signals at the assemblies 300-306. The audio signals themselves may be generated at the source device 308 from an audio file (or audio video file) stored locally at the source device 308 or in cloud storage at a remotely-located server accessible to the source device 308, for example. The audio/sound itself may be music, an audio voice recording such as a podcast, audio forming part of an audio video content presentation, etc.

As also shown in FIG. 3, respective first transducers may be located on each of the assemblies 300-306, which themselves may sit on the ground or on a relatively low surface, to emit or produce sound up and into a containment or common area 310 in the middle of the assemblies 300-306, e.g., at forty five degrees with respect to horizontal. Thus, as shown in FIG. 2, the first transducer of the assembly 300 may emit sound S1 up and into the containment area 310, the first transducer of the assembly 302 may emit sound S2 up and into the containment area 310, the first transducer of the assembly 304 may emit sound S5 up and into the containment area 310, and the first transducer of the assembly 306 may emit sound S6 up and into the containment area 310. Note that the sounds S1, S2, S5, and S6 may all correspond to the same common audio and/or audio channel from the source device 308, or may correspond to different parts of a same audio production such as left and right stereo channel feeds (or separate channel feeds) for a musical song or other audio.

FIG. 3 also shows that second transducers on each of the assemblies 300-306 may be used to emit sound up and out away from the containment area, e.g., at forty five degrees with respect to horizontal. The sound emitted by the second transducer of each assembly 300-306 may be produced from noise cancellation signals identified by the respective assembly 300-306, such as if the noise cancellation signals are generated at the respective assembly 300-306 itself or if wirelessly received from another device such as another assembly 300-306 or the source device 308. Thus, the second transducer of the assembly 300 may emit noise cancelling sound S3 up and away from the containment area 310 to at least cancel some or all of the sound S2 from the opposing assembly 302 facing the assembly 300 as it escapes the containment area 310, such as sound below one kilohertz that escapes. In some examples, the sound S3 may even be produced from generated noise cancellation signals to cumulatively cancel at least some portions of the sounds S2, S5, and S6 that escape the containment area 310 in the direction of the assembly 300, such as at least in frequencies below one kilohertz if not all frequencies for the sounds S2, S5, and S6. The cumulative sound may be identified using a microphone on the assembly 300, for example, where the assembly 300 may then execute an active noise cancellation algorithm using a digital signal processor (DSP) within it to cancel the cumulative sound detected by the microphone.

Likewise, the second transducers of the other assemblies 302-306 may also be controlled to cancel sound from an opposing transducer across the containment area 310, or to cumulatively cancel sound from the other respective assemblies that is directed into the containment area 310 but that might also escape the containment area 310. Thus, the second transducer of the assembly 302 may emit noise cancelling sound S4 up and away from the containment area 310, the second transducer of the assembly 304 may emit noise cancelling sound S7 up and away from the containment area 310, and the second transducer of the assembly 306 may emit noise cancelling sound S8 up and away from the containment area 310.

In embodiments where the second transducer of one of the assemblies 300-306 cancels sound specifically from an opposing first transducer of another one of the assemblies 300-306 (rather than cumulatively cancelling sound from each respective first transducer of the other respective assemblies as described above), the noise cancellation signals may be generated to induce the respective second transducer to, among other things, emit a cancellation sound wave of equal magnitude and frequency but opposite phase of the wave from the first transducer of the opposing assembly. If the noise cancellation signals are generated at the respective assembly itself, the magnitude, frequency, and phase of the sound to be cancelled may be detected using the microphone on the respective assembly and then the noise cancellation signal may be quickly generated using the digital signal processor (DSP) in the assembly, for example. However, the noise cancellation signals may also be received from the source device 308 since it knows what audio signals it is streaming to each of the assemblies 300-306 and hence can generate and transmit corresponding noise cancellation signals. The noise cancellation signals may also be received from the opposing assembly itself since it too knows the respective sound it is emitting into the containment area 310 using its respective first transducer and hence can also generate a corresponding noise cancellation signal to cancel the sound it is generating.

Figure 4:
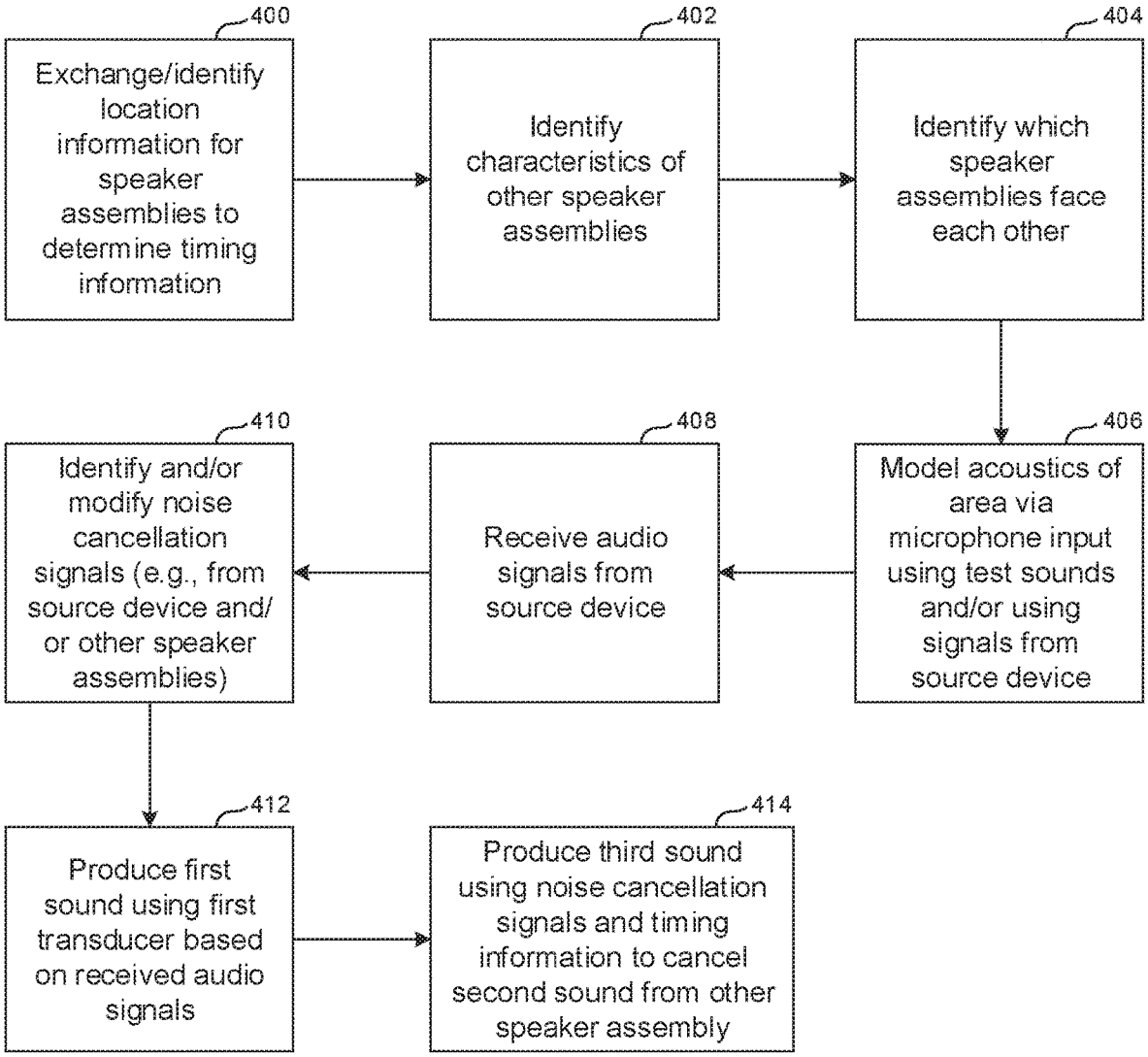
FIG. 4 shows a flow chart of an example algorithm that may be executed by an audio source device and/or one or more speaker assemblies consistent with present principles.

Before describing FIG. 4, note that in some examples the assemblies 300-306 may instead be mounted overhead at relatively high locations such as at the respective upper corners of a patio overhang or patio covering to direct sound down and in (e.g., at forty five degrees from horizontal) into a containment area rather than up and in to it. The respective second (noise cancellation) transducers of each assembly may still direct noise cancelling sound up and out at forty five degrees, or alternatively down and out at forty five degrees. In any case, the logic described below may also be used in such circumstances though not specifically described in relation to overhead speaker locations.

Now in reference to FIG. 4, it shows example logic that may be executed by a device such as one of the speaker assemblies discussed above (or even the audio source device itself) consistent with present principles. Beginning at block 400, the device may identify and/or exchange location information for the various speaker assemblies, such as responsive to one or more of the assemblies or source device being powered on. The location information may also be identified or exchanged responsive to a music player application or other audio-related application launching at the source device, responsive to the speaker assemblies establishing network connections with each other and/or the source device, etc.

The location information itself may be identified based on each other respective assembly wirelessly reporting its position information (e.g., using Wi-Fi) as sensed by a global positioning system (GPS) receiver on the respective assembly. Additionally or alternatively, the location information may be identified as determined using Wi-Fi (e.g., via the speaker's MAC address, Wi-Fi or Bluetooth signal strength, triangulation, etc. using a Wi-Fi or Bluetooth transmitter associated with each assembly location, which may be mounted on the respective assembly itself).

Regarding triangulation, a triangulation routine may be coordinated between the assemblies using ultra wide band (UWB) principles. UWB location techniques may be used, e.g., the techniques available from a member of the Fira Consortium, to determine the locations of the assemblies. Some details of this technique are described in USPP 20120120874, incorporated herein by reference. Essentially, UWB tags, in the present case mounted on the individual assembly housings, may communicate via UWB with one or more UWB readers, in the present context, mounted on the source device or a network access point that in turn may communicate with the source device. Other location determination techniques may also be used.

Once the locations of the assemblies have been determined absolutely, or at least relative to each other, the device undertaking the logic of FIG. 4 may determine timing information for when to produce noise cancelling sound to cancel the sound generated by another one or more of the assemblies as directed into the containment area. Thus, the timing information may be used in order to cancel the other sound as it exits the containment area in the direction of the device generating the noise cancellation sounds based on when the sound from the other assembly will reach and emanate past the noise cancellation transducer of the cancelling device. This may be done in order to propagate noise cancellation sound waves of opposite phases in parallel with the sound waves from the other assembly as they travel past the cancelling device. To this end, the time of flight of sound from the other assembly may be calculated by dividing the distance between the cancelling device and the other assembly by the speed of sound. The speed of sound may be assumed to be 343 meters per second in dry air at 20° Celsius. Alternatively, input from climate sensors such as a temperature and/or humidity sensor on the source device or one of the assemblies may be used to determine a current temperature and humidity (or air density more generally) at the location to then lookup the applicable speed of sound at that temperature and/or humidity at an Internet server or other storage location. Or temperature and humidity data accessed over the Internet and associated with the current location of the source device and assemblies may be used to similarly lookup the applicable speed of sound.

From block 400, the logic of FIG. 4 may then proceed to block 402. At block 402 the device may identify the characteristics of the other speaker assemblies with which it is communicating. Those characteristics might include a particular frequency response, sound pressure level (SPL), and/or phase response of the respective first transducer used to emit sound directed into the containment area. The characteristics may be reported by each respective assembly itself (e.g., wirelessly) as stored in its local storage, or the respective assembly may report its make and model number which the device executing the logic of FIG. 4 may then use to lookup the associated characteristics, e.g., over the Internet. Once identified, the characteristics may then be used to modify associated noise cancellation signals to conform to the frequency response, SPL, and/or phase response of that respective first transducer(s) in order to more precisely cancel sound from that transducer.

From block 402 the logic may proceed to block 404 where, in some examples, the device may identify an opposing speaker assembly with a first transducer-bearing side facing it. Or, if the logic is being executed by a source device rather than one of the assemblies, the source device may identify opposing speaker assemblies with respective first transducer-bearing sides facing each other. These identifications may occur using images from a camera in communication with the device executing the logic of FIG. 4, such as a camera on the respective assembly or source device or mounted elsewhere in the environment. The device may then execute object recognition using the images to identify the opposing speaker assembly or assemblies.

Identifying which speaker assemblies face each other may be useful, for example, where each assembly does not have the same the frequency response, SPL, and/or phase response as other assemblies and so the opposing assembly's particular frequency response, SPL, and/or phase response may be used to modify or tailor corresponding noise cancellation signals according to those characteristics to more precisely cancel sound.

From block 404 the logic may then proceed to block 406. At block 406 the device of FIG. 4 (and/or source device) may model the acoustics of the containment area as well as possibly the surrounding areas to determine the contours or characteristics of various items that might result in constructive or destructive interference affecting sound to be cancelled. Again note that co-owned U.S. Pat. No. 9,369,801 is incorporated herein by reference and describes noise cancelation techniques involving acoustic modeling for generating noise cancellation acoustic waves that may be used consistent with present principles.

So, for example, room dimensions or the dimensions of whatever area establishes the containment area may be determined based on user input, the device accessing an electronic map of the area, using input from a camera along with object recognition and spatial analysis software, and/or the device detecting enclosure walls and other objects using test chirps from speakers and receiving echoes using microphones. Acoustic modelling may then be performed using sonic wave calculations known in the art, in which the acoustic waves frequencies (and their harmonics) from each speaker assembly, given its frequency response assignation, may be computationally modeled in the containment area and the locations of constructive and destructive wave interference determined based on where the speaker assembly is located and where walls and other objects are located. The computations may be executed, e.g., by the device undertaking the logic of FIG. 4, by the source device, by the CE device 12 and/or by the cloud server 60.

From block 406 the logic may then proceed to block 408. At block 408 the device may receive audio signals from the source device for producing audio using its respective first transducer that is oriented up and into the containment area. The logic may then proceed to block 410 where the device may identify and, if it has not been done already, modify noise cancellation signals according to the identified speaker characteristics and acoustic modeling using an active noise cancelling algorithm. Again, note that the noise cancellation signals may be generated at the particular speaker assembly executing the logic of FIG. 4, another speaker assembly that then transmitted the signals to the device of FIG. 4, or the source device itself.

From block 410 the logic may then proceed to block 412. At block 412 the device may produce first sound using its first transducer to emit the sound up and into the containment area based on audio signals received from the source device. Then at block 414 the device may produce third sound using the modified noise cancellation signals according to the determined timing information to cancel second sound from the first transducer of the other speaker assembly opposing the device, and/or to cancel cumulative sound emanating past the device as identified by the device using signals from its microphone. In either case, in some examples the noise cancellation signals may be tailored to cancel sound in all frequencies corresponding to the second sound or, in other examples, to cancel sound in frequencies up to one kilohertz (kHz) but not frequencies above one kHz (e.g., to minimize processing time and effort).

From block 414 the logic may end or revert back to block 400. For example, the logic may revert back to block 400 responsive to another/new speaker assembly being powered on and/or connecting to the same network over which the other assemblies are already communicating. Thus, based on the new speaker assembly joining the network, the device executing the logic of FIG. 4 may execute the logic again to add in the new assembly and re-optimize the sound space/containment area to incorporate the new assembly.

Figure 5:
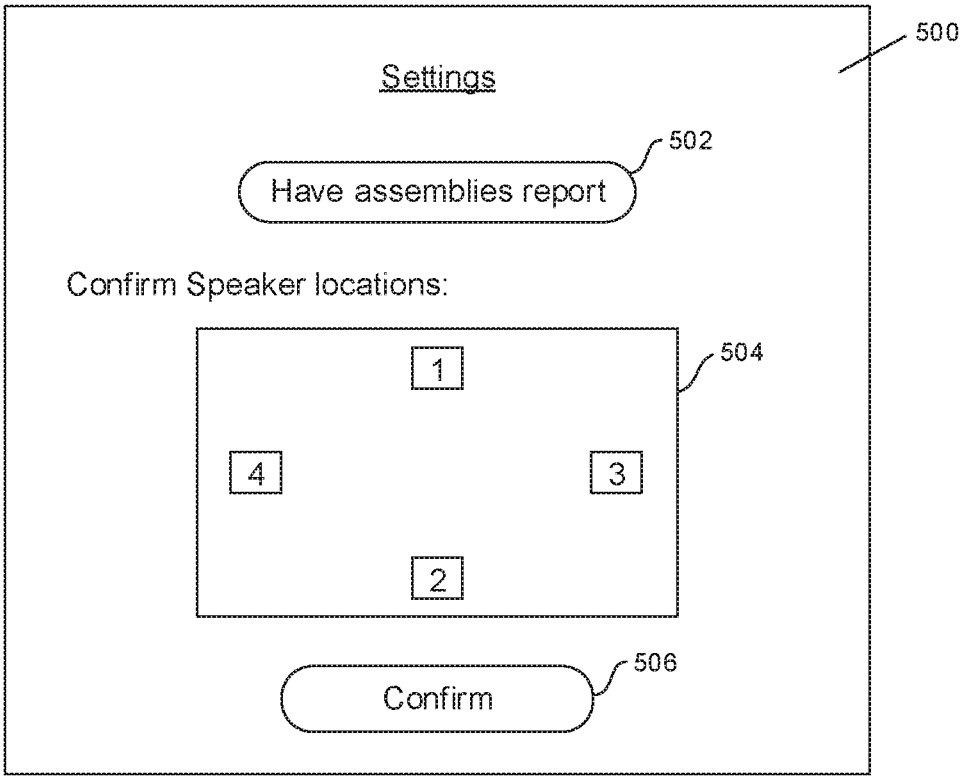
FIG. 5 shows a graphical user interface (GUI) that may be presented on the display of the source device for confirming speaker assembly locations consistent with present principles.

Continuing the detailed description in reference to FIG. 5, it shows an example graphical user interface (GUI) 500 that may be presented on the display of a source device or another suitable device consistent with present principles. As shown, the GUI 500 may include a selector or button 502 that may be selectable using touch or cursor input to command speaker assemblies with which the source device communicates to report their current locations and other information such as frequency response, sound pressure level (SPL), and/or phase response for the source device to use consistent with present principles, such as to execute the logic of FIG. 4 discussed above.

Then based on the reporting performed responsive to selection of the selector 502, or responsive to autonomous reporting by each device (e.g., at speaker assembly power on and/or wireless connection to the source device), the GUI 500 may also present a graphical map 504 indicating the speaker assembly locations with respect to each other to establish a containment area. If the map 504 looks correct to the user, the user may select the selector 506 to confirm so that the locations and other information may be used consistent with present principles. If not correct, the user may drag and release the representative boxes for the assemblies shown within the map 504 and then the end-user may select the selector 506 to confirm those new locations.

While particular techniques are herein shown and described in detail, it is to be understood that the subject matter which is encompassed by the present invention is limited only by the claims.

What is claimed is:

1. An apparatus, comprising:

at least a first audio speaker assembly comprising at least a first transducer and a second transducer, at least the first transducer defining a sonic axis oriented upwardly at an oblique angle with respect to horizontal, the first audio speaker assembly comprising at least a first microphone and at least one processor programmed with instructions to receive signals from the first microphone and to control the first and second transducers;

at least a second audio speaker assembly comprising at least a third transducer and a fourth transducer, at least the third transducer defining a sonic axis oriented upwardly at an oblique angle with respect to horizontal and toward the first audio speaker assembly, the second audio speaker assembly comprising at least a second microphone and at least one processor programmed with instructions to receive signals from the second microphone and to control the third and fourth transducers;

storage accessible to at least one processor and comprising instructions executable by at least one processor to:

produce first sound using one of the first transducer and the third transducer;

identify noise cancellation signals to cancel second sound that is produced using the other of the first transducer and the third transducer;

receive at least a first signal from at least one microphone; and produce third sound using one or more of the second transducer and the fourth transducer, the third sound produced based on the noise cancellation signals, based on a current location of one or more of the first and second audio speaker assemblies, and based on the first signal from the at least one microphone, wherein the third sound at least partially cancels the second sound.

2. The apparatus of claim 1, wherein the instructions are executable to:

produce the first sound using the first transducer;

identify, at the first audio speaker assembly, the noise cancellation signals to cancel the second sound;

receive at least the first signal from the first microphone; and produce the third sound using the second transducer, the third sound produced based on the noise cancellation signals, based on a current location of the second audio speaker assembly, and based on the first signal from the first microphone, wherein the third sound at least partially cancels the second sound.

3. The apparatus of claim 2, wherein the noise cancellation signals are first noise cancellation signals, and wherein the instructions are executable to:

produce the second sound using the third transducer;

identify, at the second audio speaker assembly, second noise cancellation signals to cancel the first sound;

receive at least a second signal from the second microphone; and produce fourth sound using the fourth transducer, the fourth sound produced based on the second noise cancellation signals, based on a current location of the first audio speaker assembly, and based on the second signal from the second microphone, wherein the fourth sound at least partially cancels the first sound.

4. The apparatus of claim 3, wherein the first sound and the second sound are produced based on signals from a source device.

5. The apparatus of claim 4, wherein the third sound and the fourth sound are produced based on signals from the source device.

6. An apparatus, comprising:

at least a first audio speaker assembly comprising at least a first transducer and a second transducer, the first audio speaker assembly comprising at least a first microphone and at least one processor programmed with instructions to receive signals from the first microphone and to control the first and second transducers;

at least a second audio speaker assembly comprising at least a third transducer and a fourth transducer, at least the third transducer defining a sonic axis oriented toward the first audio speaker assembly, the second audio speaker assembly comprising at least a second microphone and at least one processor programmed with instructions to receive signals from the second microphone and to control the third and fourth transducers;

at least one of the processors being programmed to:

produce first sound using one of the first transducer and the third transducer;

identify noise cancellation signals to cancel second sound that is produced using the other of the first transducer and the third transducer;

receive at least a first signal from at least one microphone;

produce third sound using one or more of the second transducer and the fourth transducer, the third sound produced based on the noise cancellation signals, wherein the third sound at least partially cancels the second sound;

produce the first sound using the first transducer;

identify, at the first audio speaker assembly, the noise cancellation signals to cancel the second sound;

receive at least the first signal from the first microphone;

produce the third sound using the second transducer, the third sound produced based on the noise cancellation signals, based on a current location of the second audio speaker assembly, and based on the first signal from the first microphone, wherein the third sound at least partially cancels the second sound, wherein the noise cancellation signals are first noise cancellation signals, and wherein at least one of the processors is programmed to:

produce the second sound using the third transducer;

identify, at the second audio speaker assembly, second noise cancellation signals to cancel the first sound;

receive at least a second signal from the second microphone; and produce fourth sound using the fourth transducer, the fourth sound produced based on the second noise cancellation signals, wherein the fourth sound at least partially cancels the first sound, wherein the third sound is produced based on signals from the second audio speaker assembly, and wherein the fourth sound is produced based on signals from the first audio speaker assembly.

7. An apparatus, comprising:

at least a first audio speaker assembly comprising at least a first transducer and a second transducer, at least the first transducer defining a sonic axis, the first audio speaker assembly comprising at least a first microphone and at least one processor programmed with instructions to receive signals from the first microphone and to control the first and second transducers;

at least a second audio speaker assembly comprising at least a third transducer and a fourth transducer, at least the third transducer defining a sonic axis oriented toward the first audio speaker assembly, the second audio speaker assembly comprising at least a second microphone and at least one processor programmed with instructions to receive signals from the second microphone and to control the third and fourth transducers;

at least one of the processors being programmed to:

produce first sound using one of the first transducer and the third transducer;

identify noise cancellation signals to cancel second sound that is produced using the other of the first transducer and the third transducer;

receive at least a first signal from at least a first microphone and a least a second signal from a second microphone; and produce third sound using one or more of the second transducer and the fourth transducer, the third sound produced based on the noise cancellation signals, wherein the third sound at least partially cancels the second sound, wherein the noise cancellation signals are first noise cancellation signals, at least one of the processors is programmed to identify, at the second audio speaker assembly, second noise cancellation signals to cancel the first sound, and wherein the first signal from the first microphone is used to alter the first noise cancellation signals, and wherein the second signal from the second microphone is used to alter the second noise cancellation signals.

8. The apparatus of claim 7, wherein the first noise cancellation signals are also altered based on a frequency response, sound pressure level (SPL), and/or phase response of the second audio speaker assembly, and wherein the second noise cancellation signals are also altered based on a frequency response, SPL, and/or phase response of the first audio speaker assembly.

9. The apparatus of claim 7, wherein the current location of the second audio speaker assembly is used to determine timing information for production of the third sound at the first audio speaker assembly, and wherein the current location of the first audio speaker assembly is used to determine timing information for production of the fourth sound at the second audio speaker assembly.

10. The apparatus of claim 9, wherein the current locations of the first and second audio speaker assemblies are determined using ultrasonic signals, ultra-wide band (UWB) signaling, Wi-Fi signals, and/or Bluetooth signals.

11. An apparatus, comprising:

at least a first audio speaker assembly comprising at least a first transducer and a second transducer, at least the first transducer defining a sonic axis, the first audio speaker assembly comprising at least a first microphone and at least one processor programmed with instructions to receive signals from the first microphone and to control the first and second transducers;

at least a second audio speaker assembly comprising at least a third transducer and a fourth transducer, at least the third transducer defining a sonic axis oriented toward the first audio speaker assembly, the second audio speaker assembly comprising at least a second microphone and at least one processor programmed with instructions to receive signals from the second microphone and to control the third and fourth transducers;

at least one of the processors being programmed to:

produce first sound using one of the first transducer and the third transducer;

identify noise cancellation signals to cancel second sound that is produced using the other of the first transducer and the third transducer;

receive at least a first signal from at least a first microphone and a least a second signal from a second microphone; and produce third sound using one or more of the second transducer and the fourth transducer, the third sound produced based on the noise cancellation signals, wherein the third sound at least partially cancels the second sound, wherein the noise cancellation signals are first noise cancellation signals, and wherein at least one of the processors is programmed to:

produce the second sound using the third transducer;

identify, at the second audio speaker assembly, second noise cancellation signals to cancel the first sound;

wherein the first and second noise cancellation signals are generated using at least one active noise cancelling algorithm.

12. The apparatus of claim 11, wherein the first and second noise cancellation signals are generated to cancel sound in frequencies up to one kilohertz (kHz) but not frequencies above one kHz.

13. A method, comprising:

producing first sound at a first speaker assembly using a first transducer on the first speaker assembly;

identifying first noise cancellation signals to cancel second sound from a second speaker assembly different from the first speaker assembly; and concurrent with producing the first sound at the first speaker assembly, producing third sound at the first speaker assembly using a second transducer on the first speaker assembly, the third sound produced based on the first noise cancellation signals, the third sound cancelling at least some portions of the second sound that are below one kilohertz.

14. The method of claim 13, comprising:

producing the second sound at the second speaker assembly using a third transducer on the second speaker assembly;

identifying second noise cancellation signals to cancel the first sound from the first speaker assembly; and concurrent with producing the second sound at the second speaker assembly, producing fourth sound at the second speaker assembly using a fourth transducer on the second speaker assembly, the fourth sound produced based on the second noise cancellation signals, the fourth sound cancelling at least some portions of the first sound that are below one kilohertz.

15. The method of claim 13, wherein the method comprises:

producing the third sound using the second transducer based on a current location of the second speaker assembly.

16. The method of claim 15, wherein the current location of the second speaker assembly is used to determine timing information for producing the third sound.

17. The method of claim 13, wherein the method comprises:

modifying the first noise cancellation signals based on input from a microphone on the first speaker assembly; and producing the third sound based on the modified first noise cancellation signals.

18. The method of claim 13, wherein the method comprises:

modifying the first noise cancellation signals based on at least one characteristic of the second speaker assembly; and producing the third sound based on the modified first noise cancellation signals.

19. At least one computer readable storage medium (CRSM) that is not a transitory signal, the at least one CRSM comprising instructions executable by at least one processor to:

produce first sound at a first speaker assembly using a first transducer on the first speaker assembly;

identify first noise cancellation signals to cancel second sound from a second speaker assembly different from the first speaker assembly; and concurrent with producing the first sound using the first transducer, produce a third sound at the first speaker assembly using a second transducer on the first speaker assembly, the third sound cancelling at least a portion of the second sound, the third sound being produced based on the first noise cancellation signals, wherein the first speaker assembly directs the first sound into a common area using the first transducer, and wherein the instructions are executable by the at least one processor to:

produce the third sound responsive to a first side of the first speaker assembly that bears the first transducer facing a second side of the second speaker assembly that bears a third transducer, the third transducer directing the second sound into the common area.

* * * * *